US007309292B2

(12) United States Patent
Tu Teng

(10) Patent No.: US 7,309,292 B2
(45) Date of Patent: Dec. 18, 2007

(54) SWING TRAINING DEVICE FOR GOLF CLUB

(76) Inventor: Chung-Hsing Tu Teng, No. 6, Alley 3, Lane 460, Sec. 2, Jhihshan Rd., Shihlin District, Taipei City 111 (TW)

( * ) Notice: Subject to any disclaimer, the term of this patent is extended or adjusted under 35 U.S.C. 154(b) by 71 days.

(21) Appl. No.: 11/154,468

(22) Filed: Jun. 17, 2005

(65) Prior Publication Data

US 2006/0270487 A1 Nov. 30, 2006

(51) Int. Cl.
*A63B 69/36* (2006.01)

(52) U.S. Cl. ..... 473/256

(58) Field of Classification Search ..... 473/219, 473/220, 226, 256, 437
See application file for complete search history.

(56) References Cited

U.S. PATENT DOCUMENTS

| | | | | |
|---|---|---|---|---|
| 2,608,409 | A * | 8/1952 | Pinkerton | 473/256 |
| 3,458,203 | A * | 7/1969 | Mangis | 473/256 |
| 3,716,239 | A * | 2/1973 | Goudreau | 473/256 |
| 3,820,795 | A * | 6/1974 | Taylor | 473/220 |
| 4,588,191 | A * | 5/1986 | Stewart | 473/256 |
| 5,460,378 | A * | 10/1995 | Getts | 473/251 |
| 5,766,088 | A | 6/1998 | Severtsen | |
| 6,083,116 | A * | 7/2000 | Loredo | 473/256 |
| 6,758,761 | B2 * | 7/2004 | Katsuya | 473/256 |
| 2002/0128085 | A1 * | 9/2002 | Kallassy | 473/256 |
| 2004/0023726 | A1 * | 2/2004 | Ritson et al. | 473/220 |
| 2005/0245324 | A1 * | 11/2005 | Light | 473/256 |
| 2006/0270487 | A1 * | 11/2006 | Tu Teng | 473/256 |

* cited by examiner

*Primary Examiner*—Raleigh W. Chiu
(74) *Attorney, Agent, or Firm*—Browdy and Neimark, PLLC

(57) ABSTRACT

A swing training device includes an axial hole and a gap communicated with the axial hole. A diameter of the axial hole is greater than or equal to a diameter of the neck of the head of the golf club. A width of the gap is greater than a diameter of the shaft of the club at a portion adjacent to the head, and the diameter of the neck is greater than the width of the gap. To mount the device of the present invention on a golf club, the device is fitted to the shaft via the gap, and then is moved downwards to be engaged with the neck of the head firmly.

10 Claims, 9 Drawing Sheets

SWING TRAINING DEVICE FOR GOLF CLUB

BACKGROUND OF THE INVENTION

1. Field of the Invention

The present invention relates generally to a golf club relative device, and more particularly to a swing training device of a golf club.

2. Description of the Related Art

Golfers usually swing the golf clubs without the ball to practice or modify the path of swing. Such swings also exercise muscles for warm up. We see golfers take the swings anywhere with enough space, such as at home, office, driving range or course. Golfers usually take the swings frequently to improve the swing skill.

U.S. Pat. No. 5,766,088 disclosed a swing weight assembly for a golf club. The invention provides a resilient elastomeric member fitted to the butt end of the shaft, in which coins are received, to adjust the swing weight of the club. Such assembly increases the weight of the golf club but shifting the center of the weight of the club toward the butt end of the shaft that is bad for swing training.

SUMMARY OF THE INVENTION

The primary objective of the present invention is to provide a swing training device for a golf club, which can increase the strength of shot.

The secondary objective of the present invention is to provide a swing training device for a golf club, which show the golfer the path of the swing by visual to monitor or correct the swing.

According to the primary objective of the present invention, a swing training device of the present invention, which is mounted on a golf club with a shaft connected to a neck of a head, includes an axial hole and a gap communicated with the axial hole. The swing training device has a substantially C-shaped aspect in a cross section. A diameter of the axial hole is greater than or equal to a diameter of the neck of the head of the golf club. A width of the gap is greater than a diameter of the shaft of the club at a portion adjacent to the head, and the diameter of the neck is greater than the width of the gap. To mount the device of the present invention on a golf club, the device is fitted to the shaft of the golf club via the gap, and then is moved downwards to be engaged with the neck of the head. Because the width of the gap is smaller than the diameter of the neck, the device will not escape from the golf club when swing. To disassemble the device from the golf club, the device is moved upwards, and moved transversely to take the device off the golf club.

According to the secondary objective of the present invention, the swing training device of the present invention is provided with a light emitting member on an end thereof to project light or flash light to the golfer. As a result, the golfer can see the path of the swing by visual for golfer to correct or monitor the swing.

DETAILED DESCRIPTION OF THE INVENTION

Figure 1:
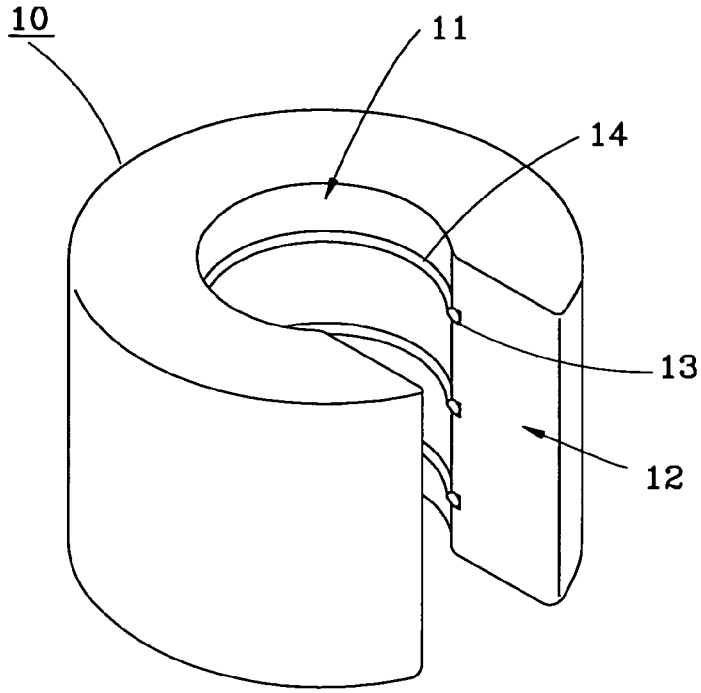
FIG. 1 is a perspective view of a first preferred embodiment of the present invention.
Figure 2:
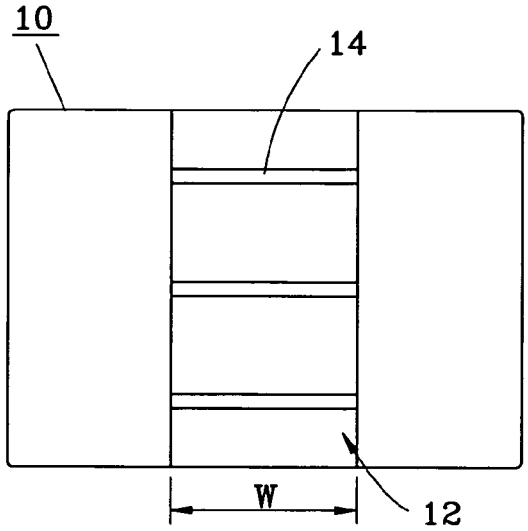
FIG. 2 is a front view of FIG. 1.
Figure 3:
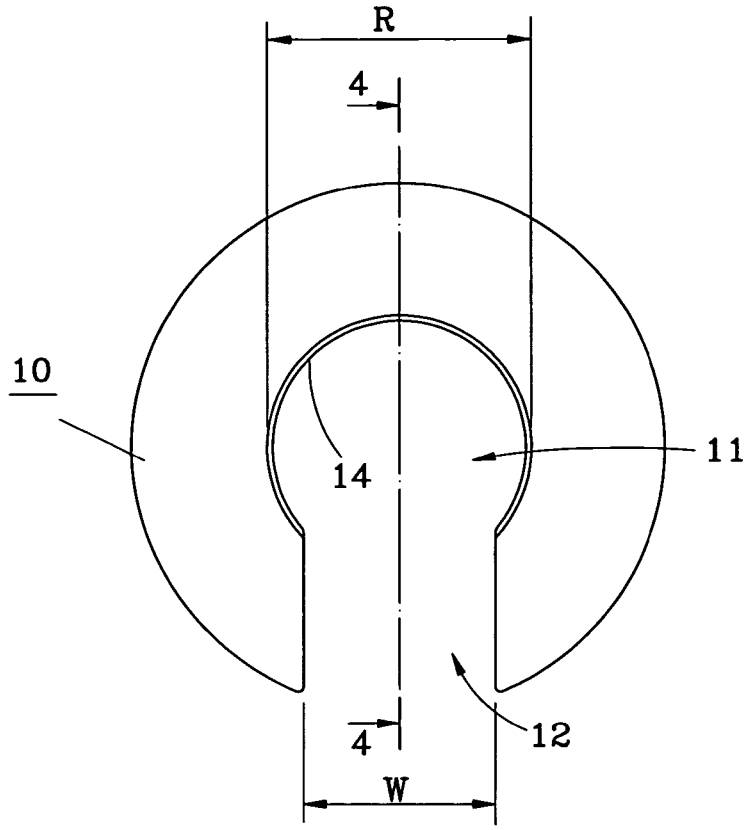
FIG. 3 is a top view of FIG. 1.
Figure 4:
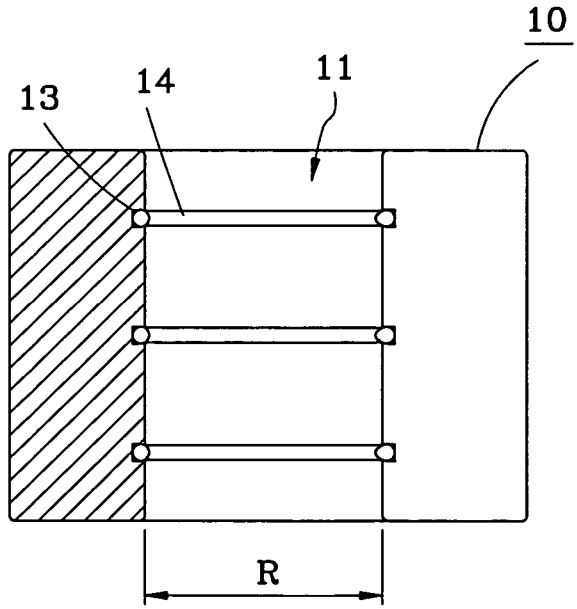
FIG. 4 is a sectional view along the 4-4 line of FIG. 3.

As shown in FIG. 1 to FIG. 4, a swing training device 10 of the first preferred embodiment of the present invention has a metallic column with an axial hole 11 at a center and a gap 12, such that the swing training device 10 has a C-shaped aspect in a cross section. On a sidewall of the axial hole 11, it provides three parallel slots 13, in each of which an elastic member 14 is provided respectively. The elastic members 14 have distal ends extruded out of the slots 13. A diameter R of the axial hole 11 is greater than a width W of the gap 12 ($R>W$).

Figure 5:
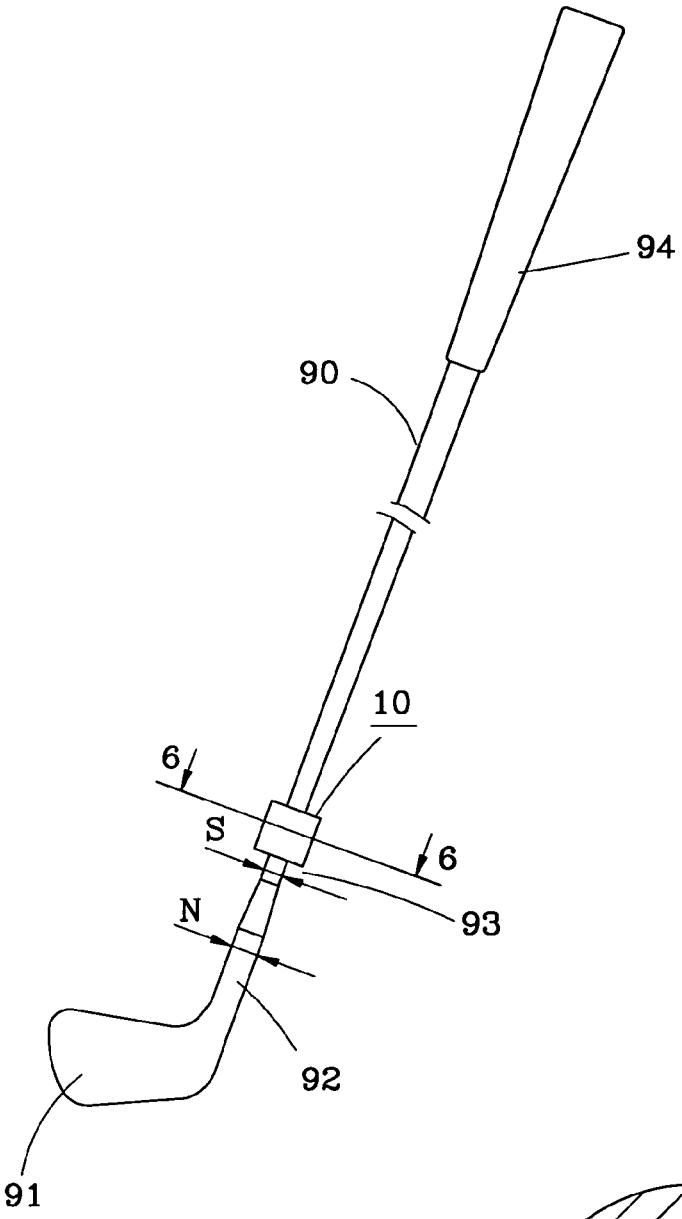
FIG. 5 is a sketch diagram of the first preferred embodiment of the present invention mounted on the golf club, which the device is fitted the shaft adjacent to the head.
Figure 6:
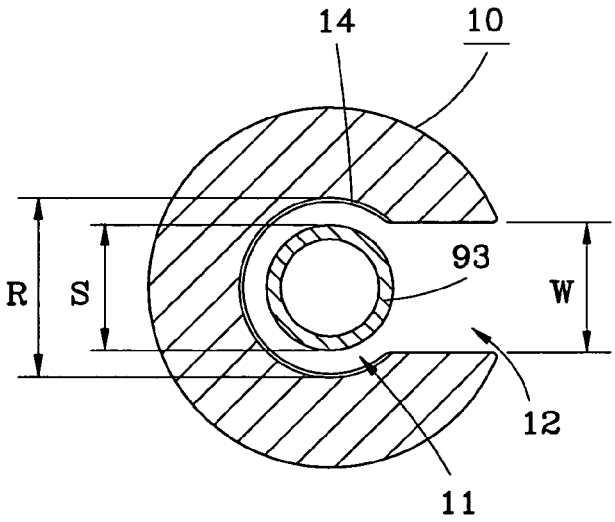
FIG. 6 is a sectional view along the 6-6 line of FIG. 5.

As shown in FIG. 5, a golf club 90 has a head 91 and a shaft 93. The head 91 has a neck 92 with a diameter defined as N. A diameter of shaft 93 adjacent to the head 91 is defined as S. A relationship between the N and S is $N>S$.

The diameter R of the axial hole 11 of the swing training device 10 is greater than or equal to the diameter N of the neck 92 of the golf club 90 ($R \geqq N$).

The width W of the gap 12 of the swing training device 10 is greater than the diameter S of the shaft 93, and the diameter N of the neck 92 is greater than the width W of the gap 12 ($N>W>S$).

In conclusion, a relationship between the R, W, N and S is $R \geqq N>W>S$.

Figure 7:
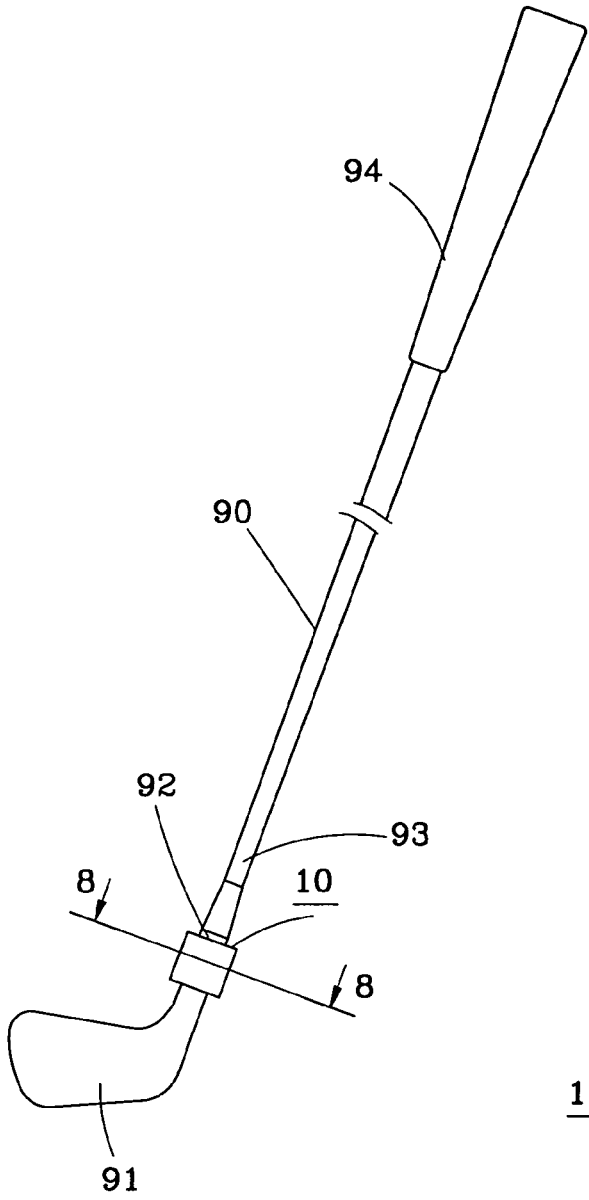
FIG. 7 is a sketch diagram of the first preferred embodiment of the present invention mounted on the golf club, which the device is moved downwards and fitted to the neck portion.
Figure 8:
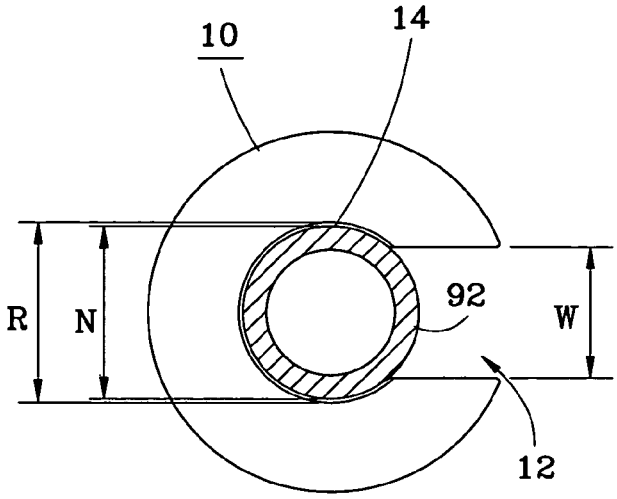
FIG. 8 is a sectional view along the 8-8 line of FIG. 7.

As shown in FIG. 5 to FIG. 8, the swing training device 10 is mounted on the golf club 90 by inserting the shaft 93 at the portion adjacent to the head 92 into the axial hole 11 of the swing training device 10 via the gap 12 (FIGS. 5 and 6), and then moving the swing training device 10 downward to the neck 92 (FIGS. 7 and 8). Because the diameter N of the neck 92 is greater than the diameter R of the axial 11, the swing training device 10 of the present invention is fitted to the neck 92 of the golf club 90 in an interference fitness. The action of fitting the swing training device 10 of the present invention to the neck 92 of the golf club 90 can be simply done by swinging the golf club 90. The gravity will draw the swing training device 10 to the neck 92 when swing. The swing training device 10 of the present invention is secured on the golf club 90 firmly when the golfer swings, such that the swing training device 10 of the present invention is very safe in swing.

While user wants to disassemble the swing training device 10 of the present invention, he/she just moves the device 10 upwards to disengage the device 10 from the neck 92, and then draws the device 10 transversely to disassemble the device 10 from the shaft 93 via the gap 12. It is an easy operation.

The golf clubs have various dimensions because of the different clubs or because they are made by different manufacturers. The variety in dimensions is smaller that the swing training device 10 of the present invention can be mounted on all of the golf clubs in the market. The elastic members 14 give a help to secure the swing training device 10 on the various golf clubs. The elastic members 14 are compressed when the device 10 is fitted to the neck 92 that provides a tighter fitness. The elastic members 14 also provide a damping capacity between the swing training device 10 and the golf club 90 that protects both of the device 10 and the club 90 from damage. The diameter of the axial hole 11 may be bigger to fit to all of the golf clubs because of the elastic members 14, and the swing training device 10 of the present invention will not disengaged with the neck 92 when upswing.

Figure 9:
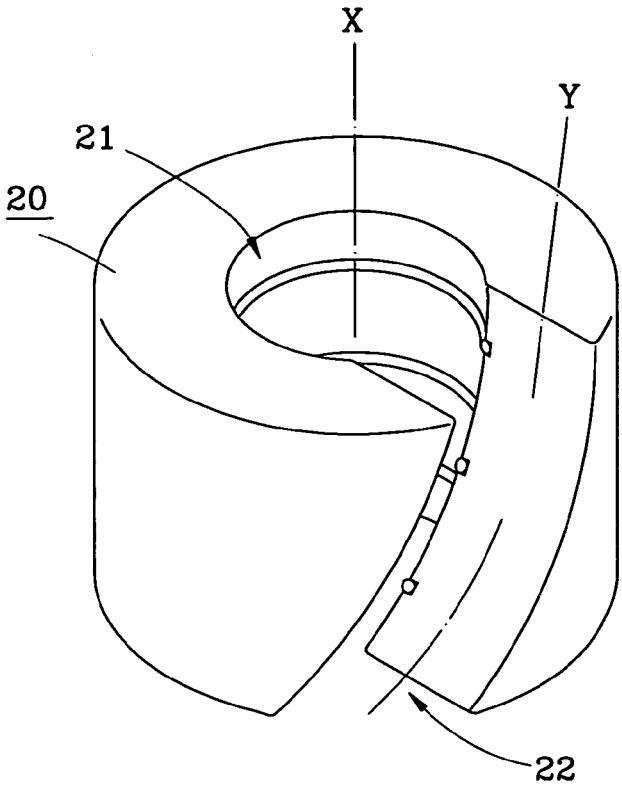
FIG. 9 is a perspective view of a second preferred embodiment of the present invention.
Figure 10:
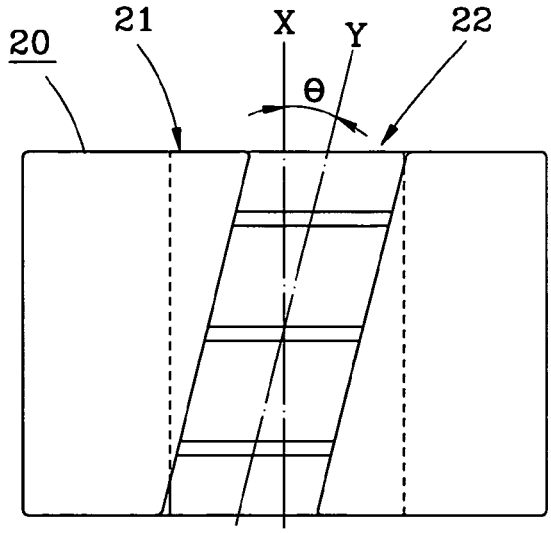
FIG. 10 is a front view of FIG. 9.

As shown in FIG. 9 and FIG. 10, a swing training device 20 of the second preferred embodiment of the present invention is similar to the device 10 of the first preferred embodiment, except that an orientation X of an axial hole 21 is not parallel to an orientation Y of a gap 22. In other words, the orientation Y of the gap 22 is tilted for an angle è relative to the orientation X of the axial hole 21. To assemble the swing training device 20 to a golf club 90, the gap 22 has to be aligned to the shaft 93 first, which means the swing training device 20 has to be turned for the angle è to enter the shaft 93 into the axial hole 21 of the swing training device 20 via the gap 22. After that, the swing training device 20 is turned back to be moved to the neck 92 of the golf club 90 and engaged therewith. The swing training device 20 of the second preferred embodiment provides a further security function that the swing training device 20 will not escape from the golf club 90 even when the swing training device 20 is disengaged with the neck 92.

Figure 11:
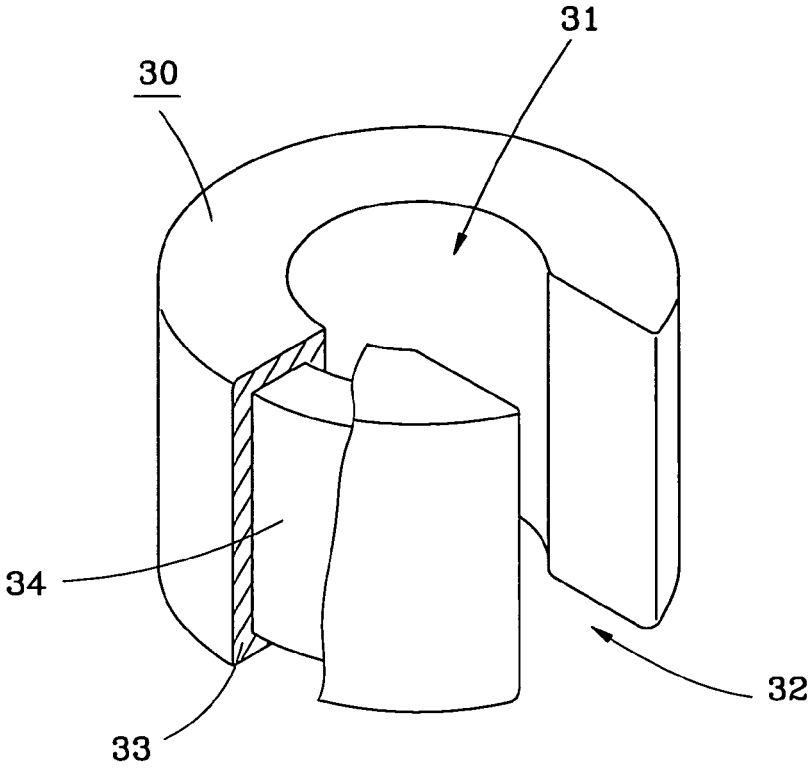
FIG. 11 is a perspective view of a third preferred embodiment of the present invention.

As shown in FIG. 11, a swing training device 30 of the third preferred embodiment of the present invention is similar to the device 10 of the first preferred embodiment, except that the swing training device 30 has a housing 33, which is made of rubber, plastic or a mixture of rubber and plastic, in which a weight member 34 is received. The weight member 34 may be a C-shaped metallic block or metallic grains or pellets. Because the housing 33 made of rubber and/or plastic has flexibility, there is no slot and elastic member on the housing 33 as the first preferred embodiment disclosed.

Figure 12:
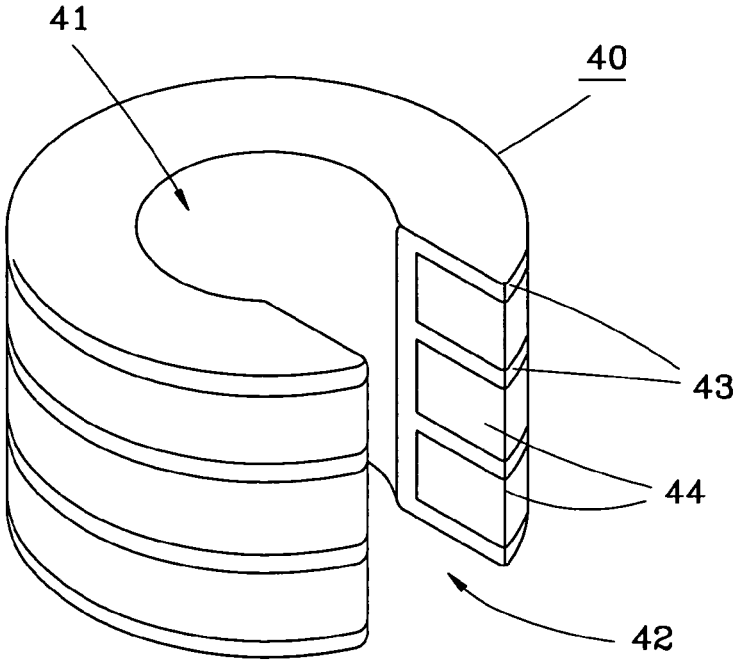
FIG. 12 is a perspective view of a fourth preferred embodiment of the present invention.

FIG. 12 shows a swing training device 40 of the fourth preferred embodiment of the present invention including an axial hole 41, a gap 42 and a housing 43 made of rubber and/or plastic. The housing 43 is provided with slots on an exterior side thereof to mount C-shaped weight members 44 on the housing 43. The swing training device 40 of the fourth preferred embodiment can change the weight thereof according to the number of the weight members 44 mounted on the housing 43. The weight members 44 can have various weights also, such that user can decide how many weight members 44 to be mounted on the swing training device 40 to fit his/her physical power.

Figure 13:
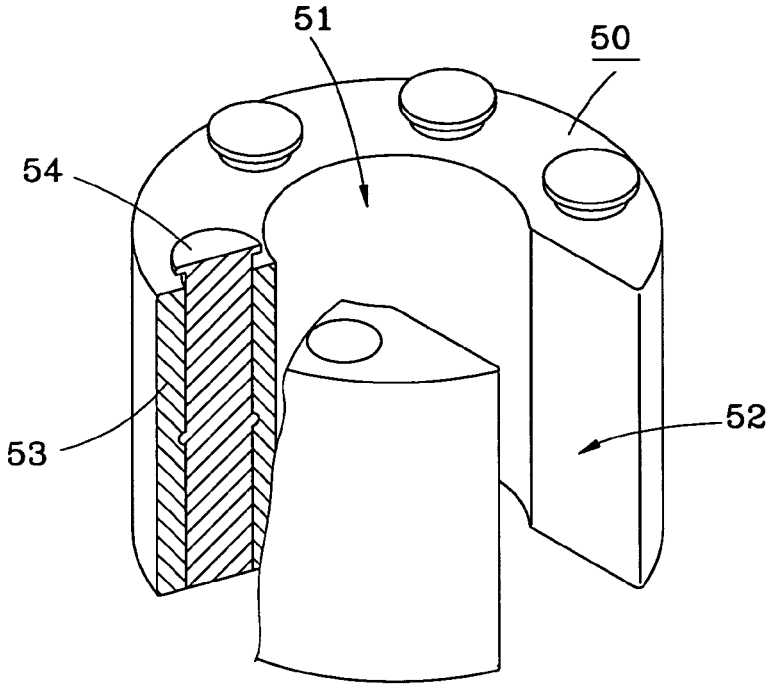
FIG. 13 is a perspective view of a fifth preferred embodiment of the present invention.

FIG. 13 shows a swing training device 50 of the fifth preferred embodiment of the present invention including an axial hole 51, a gap 52, a housing 53 and weight members 54 also. The character of the swing training device 50 of the fifth preferred embodiment is that the housing 53 is provided with holes around the axial hole 51, and the weight members 54 are inserted into the holes respectively via an end of the housing 53.

Figure 14:
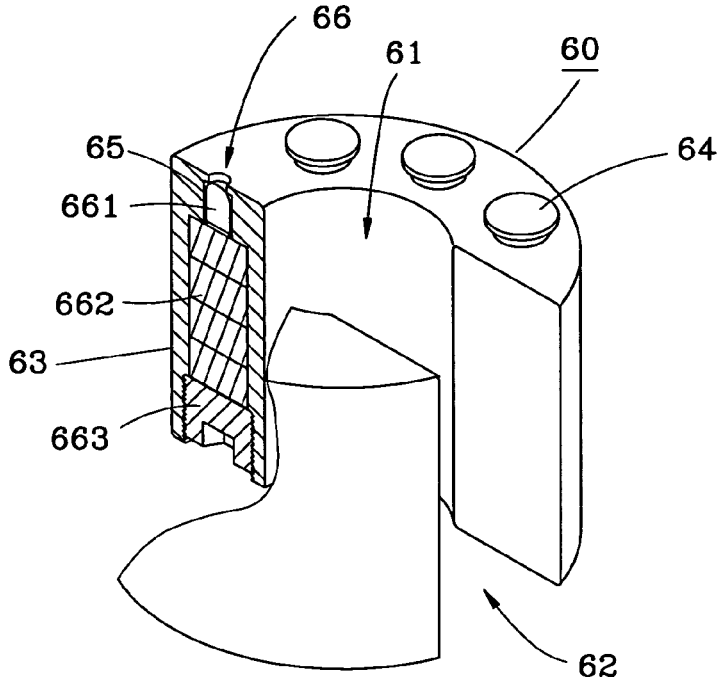
FIG. 14 is a perspective view of a sixth preferred embodiment of the present invention.
Figure 15:
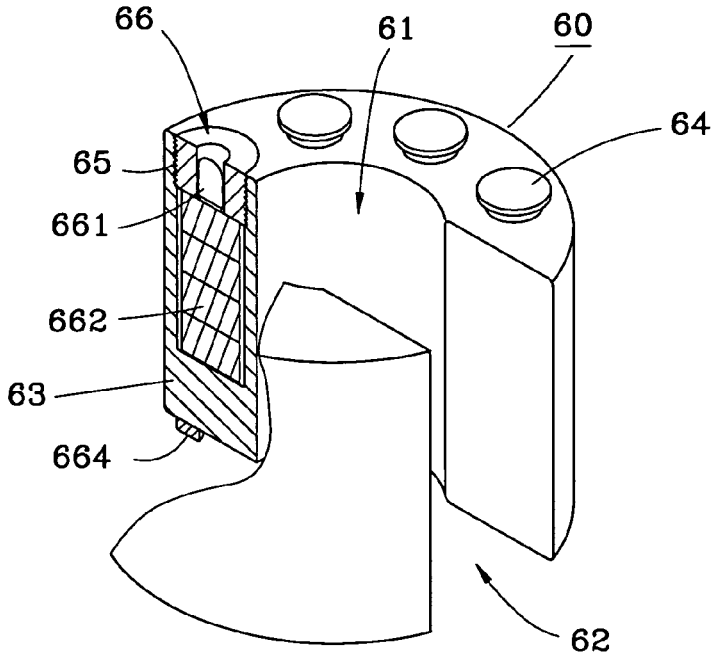
FIG. 15 is similar to FIG. 14 but the device having the switch.
Figure 16:
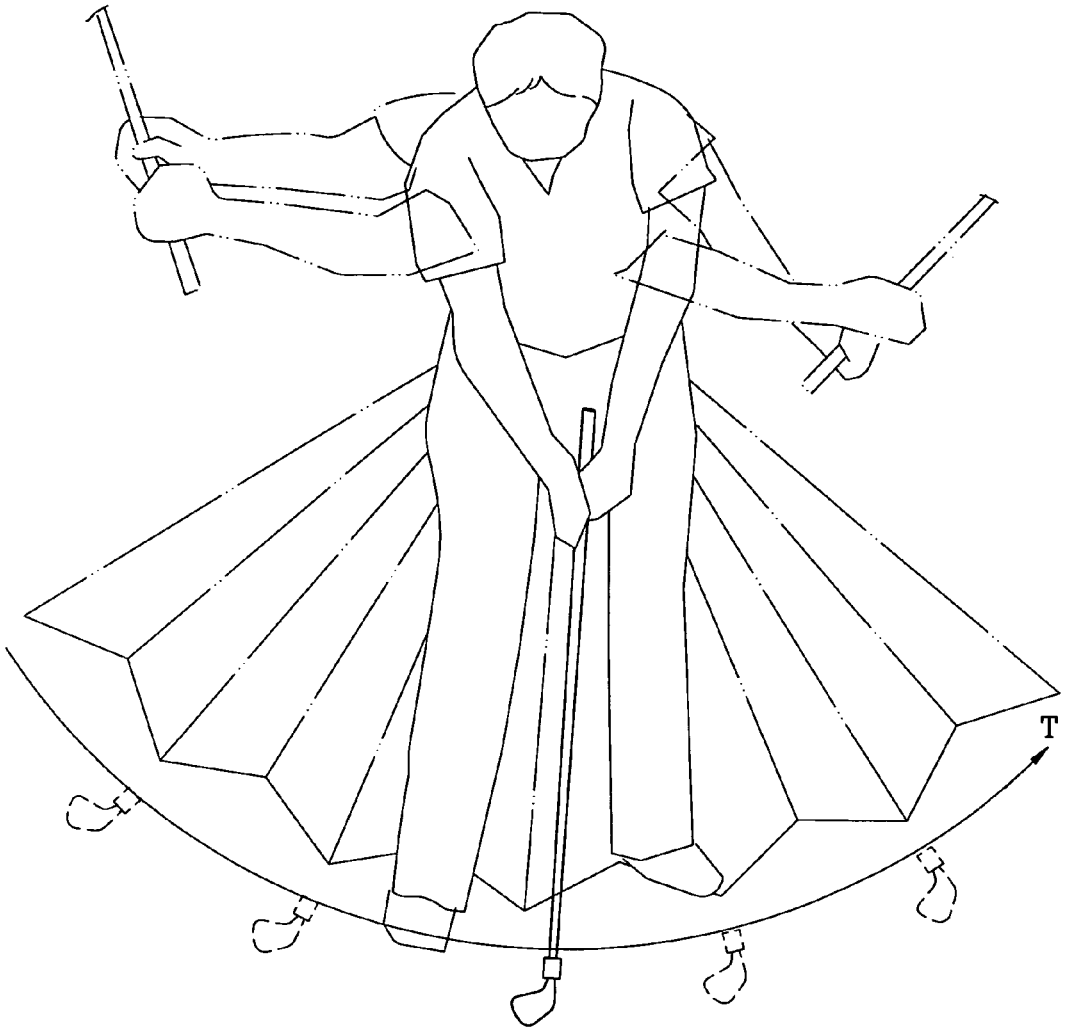
FIG. 16 is a sketch diagram, showing the LED on the device of the present invention indicating the path of swing.

FIG. 14 is a swing training device 60 of the sixth preferred embodiment of the present invention including an axial hole 61, a gap 62, a housing 63, weight members 64 and a light emitting member 66. The housing 63 is provided with a chamber 65 beside the axial hole 61 thereof, in which the light emitting member 66 is received. The light emitting member 66 includes a light emitting diode (LED) 661, a battery 662 and a lid 663. The lid 663 can be screwed tight to turn on the LED 661 or screwed loose to turn off the LED 661. FIG. 15 shows another swing training device 60, which the LED 611 is turned on and turned off by a switch 664. The LED 661 may project normal light or flash light to the golfer when swinging. As a result, the golfer can see a path T of swing clearly by visual, as shown in FIG. 16.

Figure 17:
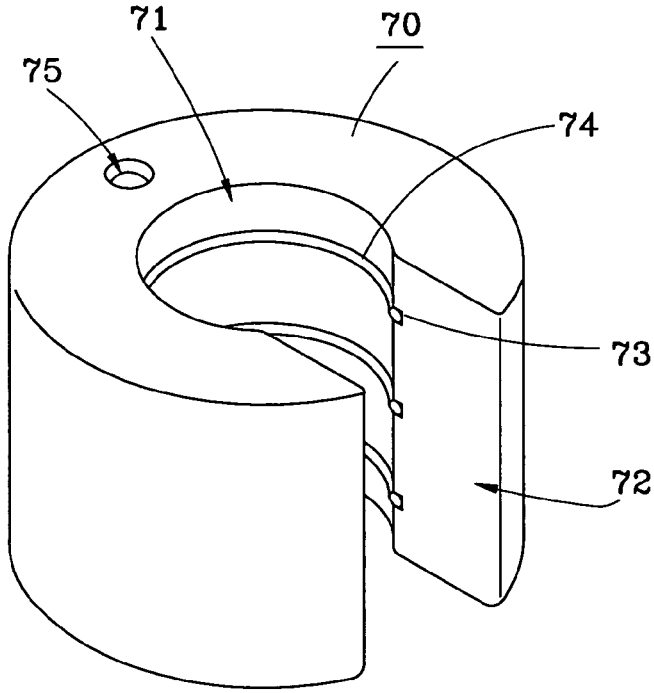
FIG. 17 is a perspective view of a seventh preferred embodiment of the present invention.

As shown in FIG. 17, a swing training device 70 of the sixth preferred embodiment of the present invention is similar to the swing training device 10 of the sixth preferred embodiment, which is made of metal and has an axial hole 71, a gap 73 and elastic members 74. The swing training device 70 is further provided with a light emitting member 75 like the sixth preferred embodiment.

What is claimed is:

1. A swing training device, which is mounted on a golf club with a shaft connected to a neck of a head, comprising an axial hole and a gap communicated with the axial hole, such that the swing training device has a substantially C-shaped aspect in a cross section, wherein an orientation of the axial hole is tilted relative to that of the gap, wherein a diameter of the axial hole is greater than or equal to a diameter of the neck of the head of the golf club, a width of the gap is greater than a diameter of the shaft of the club at a portion adjacent to the head, and the diameter of the neck is greater than the width of the gap.

2. The swing training device as defined in claim 1, wherein the device is made of metal.

3. The swing training device as defined in claim 1, further comprising an elastic member provided on a sidewall of the axial hole.

4. The swing training device as defined in claim 3, wherein the device is provided with a slot on the sidewall, and the elastic member is fixed in the slot with a distal end thereof extruded out of the slot.

5. The swing training device as defined in claim 1, wherein the device has a housing made of a flexible material with the axial hole and the gap, in which at least a weight member is received.

6. The swing training device as defined in claim 5, wherein the weight member is a metallic block embedded in the housing.

7. The swing training device as defined in claim 1, wherein the weight member is metallic grains or pellets filled in the housing.

8. The swing training device as defined in claim 1, further comprising a light emitting member projecting light to who hold the golf club.

9. The swing training device as defined in claim 8, wherein the light emitting device has a light emitting diode and at least a battery.

10. The swing training device as defined in claim 9, wherein the light emitting device further has a switch to turn on or turn off the light emitting diode.

* * * * *